US006779632B1

(12) United States Patent
Parks, III

(10) Patent No.: US 6,779,632 B1
(45) Date of Patent: Aug. 24, 2004

(54) ADJUSTABLE LEVELING STEPLADDER

(76) Inventor: Claude A. Parks, III, P.O. Box 23333, Columbia, SC (US) 29223

( * ) Notice: Subject to any disclaimer, the term of this patent is extended or adjusted under 35 U.S.C. 154(b) by 175 days.

(21) Appl. No.: 09/299,678

(22) Filed: Apr. 26, 1999

(51) Int. Cl.[7] ..... E06C 1/00
(52) U.S. Cl. ..... 182/204; 182/200
(58) Field of Search ..... 182/200–204, 182/129, 18, 165

(56) References Cited

U.S. PATENT DOCUMENTS

| | | | | | |
|---|---|---|---|---|---|
| 1,935,349 | A | * | 11/1933 | Breslow | 182/161 |
| 2,115,395 | A | * | 4/1938 | Marvin | 182/204 |
| 2,230,015 | A | * | 1/1941 | Rich | 182/178.4 X |
| 3,414,082 | A | * | 12/1968 | Gilland | 182/204 |
| 3,861,500 | A | * | 1/1975 | Dempsey | 182/204 |
| 4,236,603 | A | * | 12/1980 | Talley | 182/204 |
| 4,497,390 | A | | 2/1985 | Wilson | 182/202 |
| 4,627,516 | A | | 12/1986 | Studer | 182/202 |
| 4,766,976 | A | | 8/1988 | Wallick, Jr. | 182/201 |
| 4,802,471 | A | | 2/1989 | Cordell | 182/204 |
| 4,844,208 | A | | 7/1989 | Veness | 182/201 |
| 5,027,923 | A | | 7/1991 | Derome | 182/201 |
| 5,064,024 | A | | 11/1991 | Barham | 182/201 |
| 5,107,958 | A | | 4/1992 | Johnson | 182/204 |
| 5,265,698 | A | * | 11/1993 | Friedel, Jr. | 182/204 X |
| 5,497,850 | A | * | 3/1996 | Patterson | 182/204 |
| 5,507,363 | A | | 4/1996 | Tredup | 182/129 |
| 5,542,497 | A | | 8/1996 | Macyszyn | 182/201 |
| 5,577,574 | A | * | 11/1996 | Joseph | 182/180 |
| 5,615,752 | A | | 4/1997 | Wassil | 182/200 |
| 5,669,462 | A | | 9/1997 | Jennings | 182/111 |
| 5,816,364 | A | * | 10/1998 | Christy et al. | 182/201 |
| 5,853,065 | A | * | 12/1998 | Hutson et al. | 182/204 X |

FOREIGN PATENT DOCUMENTS

| | | | | |
|---|---|---|---|---|
| FR | 2665924 A1 | * | 2/1992 | E06C/1/22 |

* cited by examiner

*Primary Examiner*—Hugh B. Thompson, II
(74) *Attorney, Agent, or Firm*—John D. Gugliotta

(57) ABSTRACT

An adjustable leveling stepladder is provided with telescopically adjustable support legs that allow it to be positioned on uneven surfaces. A pair of bubble levels that are used to indicate proper and safe horizontal positioning in two dimensions.

5 Claims, 4 Drawing Sheets

ADJUSTABLE LEVELING STEPLADDER

BACKGROUND OF THE INVENTION

1. Field of the Invention

The present invention relates generally to ladder type devices used to access elevated locations and more specifically to a stepladder with a pair of telescopically adjustable support legs used to position the ladder with a level orientation. Especially useful in situations requiring the use of a ladder on stairs or the like, the ladder incorporates level indicting devices that allow the ladder to be positioned easily and precisely, avoiding the dangers associated with shifting the ladder's center of gravity. In alternate embodiments, aftermarket devices are disclosed that allow the user to retrofit a conventional stepladder or dual-rail type ladder with leveling legs and level indicating devices in order to achieve an operation similar to that of the preferred embodiment.

2. Description of the Related Art

A search of the prior art did not disclose any patents that read directly on the claims of the present invention, however several references, pertaining mainly to adjustment attachments for conventional ladders, were considered related.

U.S. Pat. No. 5,577,574, issued in the name of Joseph, is of particular significance. The Joseph patent discloses an adjustable stepladder that incorporates the use of four telescoping legs to allow the user to place the ladder on uneven surfaces. Each adjustable leg employs locking pins held by springs to lock the leg in the desired position, the intent being to allow the user to place the ladder on uneven surfaces. This device, however, suffers from several problems that not only make ineffective in achieving its purpose, but also present inherent dangers to the user. It is obvious from the disclosure that the spacing of the adjustment apertures is far too large to ensure its safe operation. The result of this spacing is such that proper ladder adjustment, in many situations, would be difficult if not impossible to achieve. In the commonly occurring case where the adjustment distance required is slight, adjustment of the ladder legs could result in a more uneven ladder orientation than if it was placed on the surface without adjustment. Also, because of these problems, it will often be the case where the user must select between two or more ladder configurations, each of which presenting an uneven ladder orientation, without being able to determine which, if any, are safe to use. However, there are no provisions in the Joseph disclosure for any devices that would indicate a safe or proper ladder orientation.

Two patents disclose self-leveling ladder constructions for dual-rail type ladder designs: U.S. Pat. No. 4,627,516, issued in the name of Studer, discloses an automatic, self-leveling ladder which adjusts itself and locks to accommodate an uneven surface. The device incorporates coil springs and stub shaft gears which are automatically engaged by the weight of the ladder in order to lock the legs in a level position. U.S. Pat. No. 4,497,390, issued in the name of Wilson, discloses a self-adjusting ladder wherein sliding legs are physically linked to one another by a series of steel balls contained in a flexible tube. The balls transfer the force from one leg of the ladder to the other so that when the bottom of a leg is met with an uneven surface, the ladder will automatically level itself. The Wilson inventions suffers from an obvious problem wherein there is no means by which to lock the legs in position once adjusted to the proper level. This creates an extremely dangerous situation where the shifting of weight upon the ladder would cause the legs to react and possibly result in the ladder tipping over. The Studer invention, while providing a leg locking means, is complex in design will most likely be too expensive to successfully produce. Also, it is apparent from these disclosures that the displacement of the adjustable legs is not sufficient to accommodate a large slope, as would be the case where the user desires to use the ladder on surfaces such as stairs or the like. Furthermore, neither of these disclosures anticipate the use of any devices that would indicate a safe or proper ladder orientation, nor do they address the need to provide leveling capabilities to a stepladder-type device.

Several patents disclose ladder leveling attachments of varying designs for use with dual-rail type ladder designs wherein both legs are fit with telescopically adjustable leg extensions: U.S. Pat. No. 5,669,462, issued in the name of Jennings, discloses an adjustable ladder that incorporates the use of telescoping leg extansions, attaching them to the ladder side rails to allow the user to place the ladder on uneven surfaces. Bolts and wing nuts are used to secure the leg extensions members to each side rail. U.S. Pat. No. 5,542,497, issued in the name of Macyszyn, discloses a ladder level adjusting attachment that incorporates a self-locking cam mechanism, attached to the side rail of the ladder, that locks a telescoping leg extension in place automatically when placed on an uneven surface. U.S. Pat. No. 5,107,958, issued in the name of Johnson, discloses an apparatus consisting of a pair of telescoping leg extension attachments. A threaded screw bolt functions along with a spring pin head to hold the leg extension in position via insertion through a ladder receiving sleeve. U.S. Pat. No. 4,844,208, issued in the name of Veness, discloses an attachment for a ladder whereby a wooden extension is secured to the leg of such ladder to accommodate uneven surfaces. The attachment comprises a metal channel which receives desired length of wood for forming a ladder leg extension. A pair of shafts extend through and between the walls of the metal channel. Pins project from one shaft to engage and retain the wooden extension. A handle, welded to the shaft, actuates the pins to engage and release the wooden extension. U.S. Pat. No. 3,414,082, issued in the name of Gilland, discloses a ladder leveling apparatus intended for use with metal ladders to accommodate uneven surfaces. The telescopic attachment consists of an extension mounting member adapted for pivotal attachment. It incorporates pivot bolts and wing-nuts to be inserted at selected positions. All of these devices are intended for use with dual-rung ladders and do not anticipate use with conventional stepladder designs. Also, it is apparent from many of these disclosures that the displacement of the adjustable legs is not sufficient to accommodate a large slope, as would be the case where the user desires to use the ladder on stairs or the like. In many of these devices, the adjustments are made in increments that may not adequately compensate for the surface slope, resulting in unsafe ladder positioning. Furthermore, none of these disclosures anticipate the use of any indicating devices that would aid the user in determining a safe or proper ladder orientation.

Several patents disclose ladder leveling attachments of varying designs for use with dual-rail type ladder designs wherein one of the legs is fit with a telescopically adjustable leg extension: U.S. Pat. No. 5,064,024, issued in the name of Barham, discloses a vertically adjustable ladder leg extender apparatus for attachment to a single leg of a ladder, extending the leg in order to accommodate uneven surfaces. The device consists of a sleeve that carries an extendible support leg which slides vertically therein. The support leg is vertically adjustable and secured in place by turn bolts. U.S. Pat. No. 5,027,923, issued in the name of Derome, discloses an attachment for a ladder which includes a housing with an extensible leg to allow use on an uneven surface. A locking mechanism is mounted in the housing and consists of a cam having a lobe which engages the extensible leg. The extensible leg is moved downward by an attached foot-step. A release lever is attached for retraction into the housing. The top of the housing has a bubble level to determine when ladder is level with respect to the direction of the ladder rungs. U.S. Pat. No. 4,802,471, issued in the name of Cordell, discloses an attachment for a ladder to accommodate uneven surfaces. The attachment consists of a T-shaped gripping device with a sharp edge that makes contact with a smooth slidable rail, locking the rail into the desired position. The slidable rail extends the ladder leg, thus leveling it. Pressure is applied to the gripping device to remove contact between it and the smooth rail thus allowing the rail to have an infinite number of positions being limited only by the length of such smooth rail. An infinite number of positions are possible because a smooth surface is utilized rather than ratchets. U.S. Pat. No. 4,766,976, issued in the name of Wallick, Jr., discloses an attachment for a ladder to accommodate uneven surfaces. The apparatus provides a ladder leg extender and leveler consisting of a longitudinally extending frame structure that is attached, in a face-to-face relation to a ladder leg side. The apparatus avoids undesirable bending stresses that have formerly been placed on the rung fasteners by employing a base leg recess. The apparatus incorporates a hollow longitudinal extension leg which slides through apertures and a ball and socket arrangement to level the ladder. The apparatus further employs a number of stacked annular clamp plates and a helical spring to lock the extension leg in the desired position. U.S. Pat. No. 5,615,752, issued in the name of Wassil, discloses a ladder-leveling platform assembly in which such platform can be adjusted to accommodate an uneven surface. The assembly consists of a base with a pivotable plate that is supported on a platform. Elevation is accomplished by the use of rods that are used to maintain a plate which is joined to an axle along with a series of apertures inclined to elevate the ladder leg to a desired position. The plate receives one ladder leg. None of these leveling devices can be used in conjunction with a conventional stepladder design due to the fact that they all are intended to be placed on a single leg of a dual-rail type ladder design. Since stepladders have four legs, use of these devices would result in extremely unstable ladder positioning, creating the potential for injury. Also, it is apparent from many of these disclosures that the displacement of the adjustable legs is not sufficient to accommodate a large slope, as would be the case where the user desires to use the ladder on stairs or the like. In many of these devices, the adjustments are made in increments that may not adequately compensate for the surface slope, resulting in unsafe ladder positioning. Although the Derome device anticipates the use of a bubble level to indicate proper position indication, it fails to take into consideration the fact that a stepladder requires two-dimensional leveling, both parallel and perpendicular to the ladder rungs.

While several features exhibited within these references are incorporated into this invention, alone and in combination with other elements, the present invention is sufficiently different so as to make it distinguishable over the prior art.

SUMMARY OF THE INVENTION

The adjustable leveling stepladder adapts an otherwise conventional stepladder design with telescopically adjustable support legs that allow it to be positioned on uneven surfaces such as sloped ground or stairways. The stepladder includes a pair of bubble levels that are used to indicate proper and safe horizontal positioning in two dimensions. Encompassing several embodiments, the adjustable leveling stepladder ranges from a complete stepladder design with four adjustable legs, a two adjustable leg stepladder design, and retrofit kits wherein existing dual-rail ladders and stepladders are fit with telescoping attachments and level indicators in order to achieve the functionality of both the two and four-leg models. The adjustable legs consist of a telescoping tube construction, the length of which adjusts in small increments along its length, using threaded fasteners to lock the legs in place. The overall displacement of the legs is sufficient to accommodate large slopes and support surface differentials, allowing it to be used effectively on stairs and other like structures.

It is therefore an object of the present invention to provide an adjustable leveling stepladder that can be placed on uneven surfaces while maintaining a safe, level orientation.

It is another object of the present invention to provide an adjustable leveling stepladder whose legs are telescopically adjustable in small increments, allowing it to be placed level on sloped surfaces of varying degrees.

It is another object of the present invention to provide an adjustable leveling stepladder with telescoping legs, the longitudinal displacement of which is large, allowing it to be positioned level on uneven surfaces of large proportions, including stairs and other like structures.

It is another object of the present invention to provide an adjustable leveling stepladder that can be placed on uneven surfaces while maintaining a safe, level orientation.

It is another object of the present invention to provide an adjustable leveling stepladder that incorporates the use of bubble levels to indicate safe and proper ladder positioning.

It is another object of the present invention to provide an adjustable leveling stepladder with telescoping legs, the construction of which is simple in design, making it easy to use and making its production cost-effective.

It is another object of the present invention to provide an adjustable leveling stepladder, the material construction of which is of a high-quality, resulting in a strong, reliable, durable and safe product.

Finally, it is an object of the present invention to provide an adjustable leveling stepladder wherein the technology used to produce telescopically adjustable support legs can be transferred to dual-rail ladder designs and aftermarket ladder retrofit attachment devices.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

Figure 1:
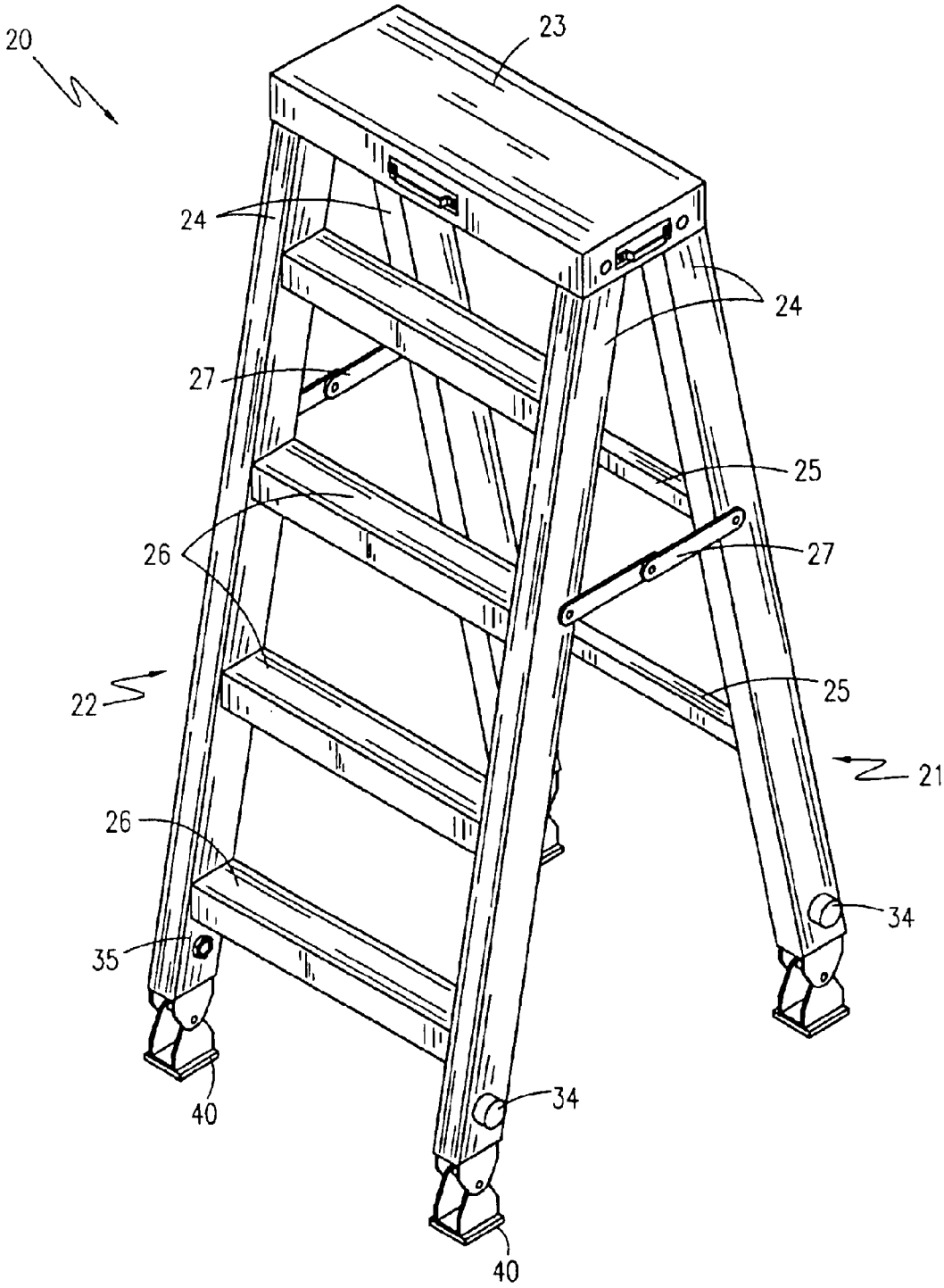
FIG. 1 is a perspective view of the adjustable leveling stepladder, according to the preferred embodiment of the present invention.
Figure 2:
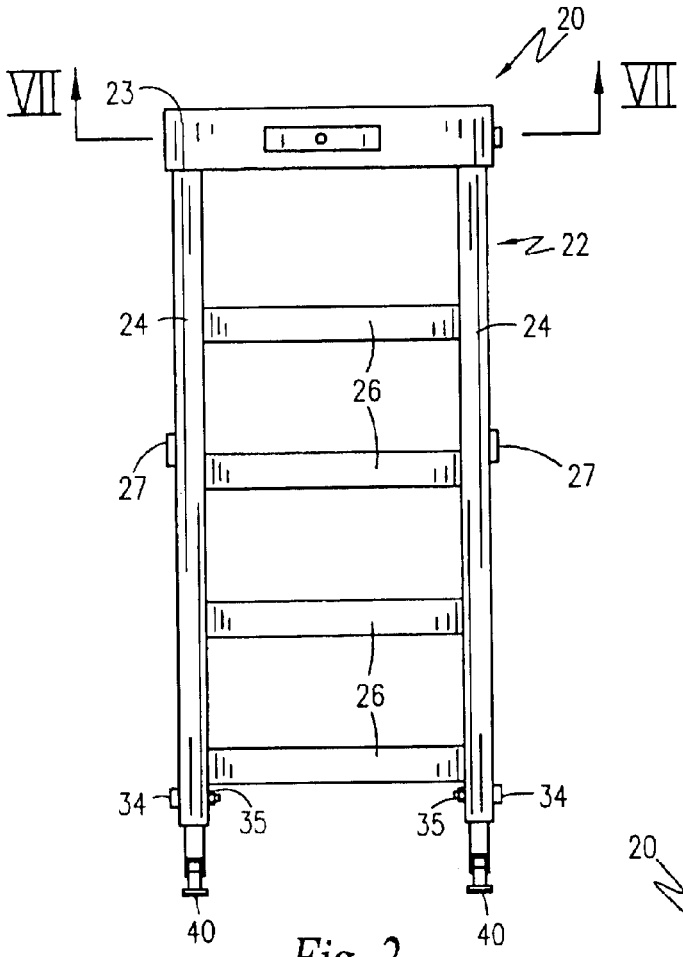
FIG. 2 is a front view of the adjustable leveling stepladder, according to the preferred embodiment of the present invention.
Figure 3:
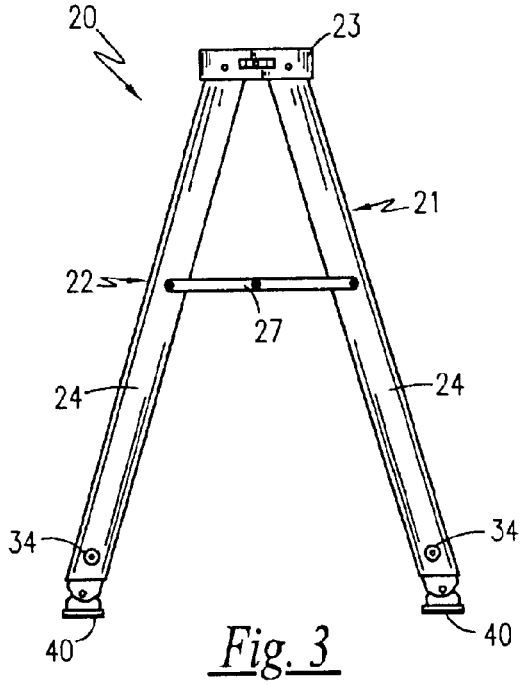
FIG. 3 is a side view of the adjustable leveling stepladder, according to the preferred embodiment of the present invention.
Figure 4:
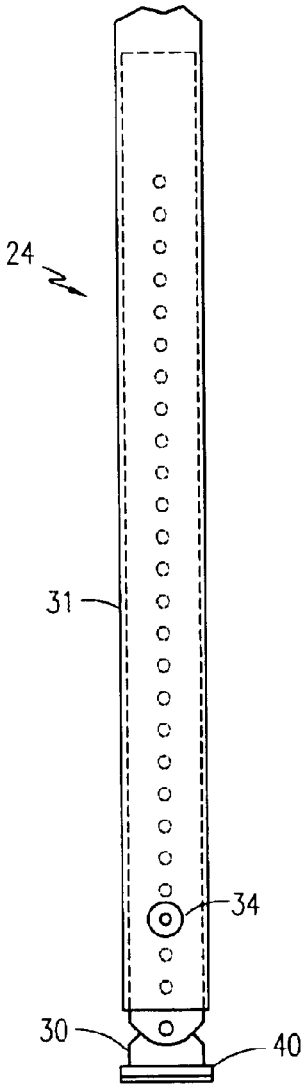
FIG. 4 is a partial side view of an adjusting leg portion of the adjustable leveling stepladder, according to the preferred embodiment of the present invention.
Figure 5:
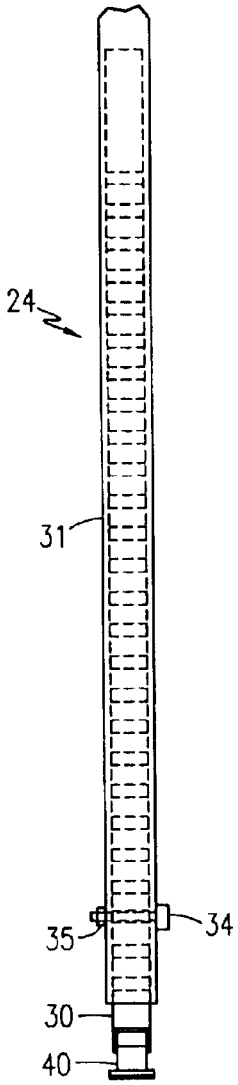
FIG. 5 is a partial front view of an adjusting leg portion of the adjustable leveling stepladder, according to the preferred embodiment of the present invention.
Figure 6:
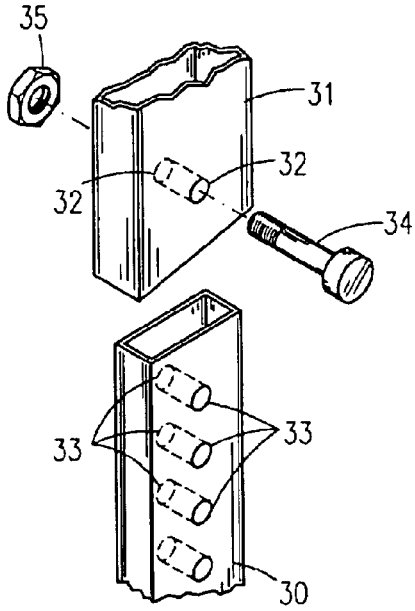
FIG. 6 is an exploded perspective view of the adjusting leg portion of the adjustable leveling stepladder, according to the preferred embodiment of the present invention.

| | |
|---|---|
| 20 | Adjustable Leveling Stepladder |
| 21 | Stabilizing Frame |
| 22 | Ladder Frame |
| 23 | Top Plate |
| 24 | Support Legs |
| 25 | Stabilizing Cross-Member |
| 26 | Step Plates |
| 27 | Folding Stabilizers |
| 30 | Telescoping Support Member |
| 31 | Housing Support Member |
| 32 | Support Apertures |
| 33 | Adjustment Apertures |
| 34 | Adjustment Pin |
| 35 | Threaded Fastener |
| 40 | Surface Engaging Foot |
| 45 | Bubble Levels |
| 46 | Danger Regions |
| 47 | Translucent Plastic Tube |
| 48 | Safe Region |

DESCRIPTION OF THE PREFERRED EMBODIMENTS

1. Detailed Description of the Figures

Referring to FIGS. 1–6, depicted is an adjustable leveling stepladder 20, according to the preferred embodiment of the present invention. Consisting essentially of a modified conventional stepladder design having telescoping legs, the adjustable leveling stepladder 20 has a stabilizing frame 21 and a ladder frame 22 hingedly connected to a top plate 23 in an opposing fashion such that they fold together. The stabilizing frame 21 consists of two support legs 24 connected in parallel to one another via at least one stabilizing cross-members 25. The ladder frame 22 consists of two support legs 24 connected in parallel to one another by a plurality of step plates 26. In a storage position, the stabilizing frame 21 and the ladder frame 22 are folded together such that they lie in a position approximately parallel to one another. In a use position, the stabilizing frame 21 and the ladder frame are extended away from one another such that they form an A-shaped profile, and are locked into position by a pair of folding stabilizers 27.

Each of the four support legs 24 consist of a telescoping support member 30 and a housing support member 31. The telescoping support member 30 and the housing support member 31 consist of elongated tubular members having a rectangular cross-section, the outside dimensions of the telescoping support member 30 being smaller than the inside dimensions of the housing support member 31. Inserted in the housing support member 31, the telescoping support member 30 slides therein, producing a support leg 24 of adjustable length. A pair of support apertures 32 are bored through opposing sidewalls of the housing support member 31, positioned in linear alignment with one another. A plurality of adjustment apertures 33 are bored through opposing sidewalls of the telescoping support member 30, along its length and positioned in pairs that are in linear alignment with one another. The arrangement of the support apertures 32 and the adjustment apertures 33 are such that, as the length of the support leg 24 is adjusted telescopically, individual pairs of adjustment apertures 33 come into linear alignment with the support apertures 32. Configured as such, an adjustment pin 34 can be inserted through both the support apertures 32 and the adjustment apertures 33, locking the telescoping support member 30 within the housing support member 31 thereby adjusting the length of the support leg 24. The adjustment pin 34 is threaded on one end, allowing the use of a threaded fastener 35 to secure it in place. Each telescoping support member 30 has a surface engaging foot 40 attached hingedly thereto, allowing it to rotate and rest flush with the surface upon which the adjustable leveling stepstepladder 20 is placed.

Figure 7A:
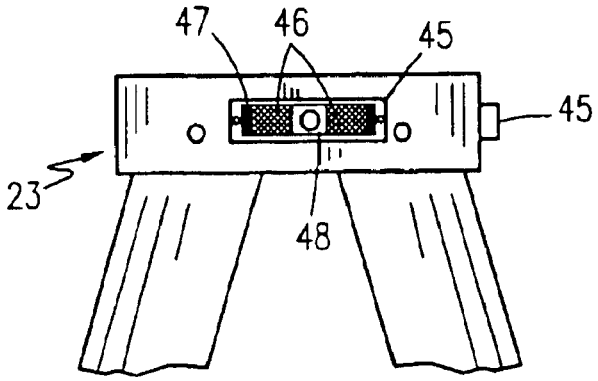
FIG. 7*a* is a sectional top of the top platform portion of the adjustable leveling stepladder, taken along line VII—VII as depicted in FIG. 2, according to the preferred embodiment of the present invention.
Figure 7B:
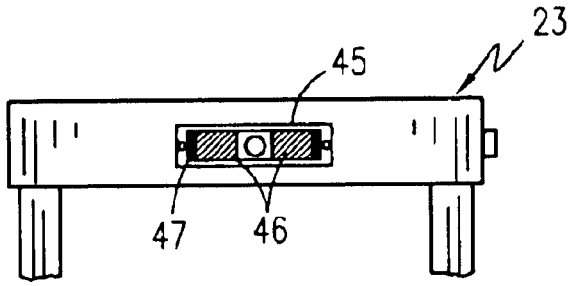
FIG. 7*b* is a partial front view of the section depicted in FIG. 7*a*.

Referring now to FIG. 7*a* and FIG. 7*b*, depicted is the top plate 23 of the adjustable leveling stepladder 20 according to the preferred embodiment of the present invention. The top plate 23 has a pair of bubble levels 45 attached thereto. The bubble levels 45 are attached along the edges of the top plate 23, oriented perpendicular to one another, providing a means by which to determine the degree of level orientation on two dimensions of the horizontal plane upon which the top plate 23 lies. Thus, the bubble levels 45 can be used to determine the proper orientation of the adjustable leveling stepladder 20. Each bubble level 45 includes danger regions 46, consisting of shaded areas on the translucent plastic tube 47 that are used to indicate when the ladder is tilted to a degree where the user's safety is compromised. A clear safe region 48 indicates that the ladder is positioned properly and is safe to use.

2. Operation of the Preferred Embodiment

According to the preferred embodiment as depicted in FIGS. 1–7, the adjustable leveling stepladder 20 is used in the following manner. When the adjustable leveling stepladder 20 is to be used on a substantially level surface, such as a floor, no adjustment is required and it can be used as a conventional stepladder. When the adjustable leveling stepladder 20 is to be used on an uneven surface, such as a slope or upon stairs, the user first extends the stabilizing frame 21 and the ladder frame 22 into the use position, locking them in place with the folding stabilizers 27. The user then performs a sight adjustment of the ladder orientation by adjusting the length of the support legs 24, sliding the telescoping support members 30 within the housing support member 31 and locking them in place using the adjustment pin 34. The user them monitors the bubble levels 45 to determine the amount of fine adjustments required and makes the appropriate alterations. Once both of the bubble levels 45 read in the safe region 48, the user locks the adjustment pins 34 in place using the threaded fasteners 35 and can climb upon the adjustable leveling stepladder 20 knowing that the center of gravity is located properly and the risk of falling is minimized.

While the preferred embodiments of the invention have been shown, illustrated and described, it will be apparent to those skilled in this field that various modifications may be made in these embodiments without departing from the spirit of the present invention or the teachings of the present disclosure. For example, embodiments in which a two adjustable leg stepladder or dual-rail ladder design are envisioned. Also, retrofit kits are envisioned wherein existing dual-rail ladders and stepladders are fit with telescoping attachments and level indicators in order to achieve both the two and four-leg operation. It is for this reason that the scope of the invention is set forth in and is to be limited only by the following claims.

What is claimed is:

1. An adjustable leveling ladder, said adjustable leveling ladder comprising:

a vertical step assembly comprising a first and second parallel support legs having a plurality of step plates traversing between said support legs and secured thereto, said support legs having a tubular cross-section with a telescoping support member inserted therein, said telescoping support member secured by a rung rail locking mechanism that allows for rung rail configurations of variable length and having a surface engaging foot pivotally attached to an end thereof for securably engaging a ladder support surface;

a vertical support assembly comprising a first and second parallel housing support members having at least one stabilizing cross member traversing between said housing support members and secured thereto, said housing support members having a tubular cross-section with a telescoping support member inserted therein, said telescoping support member secured by a support rail locking mechanism that allows for housing support member configurations of variable length and having a surface engaging foot pivotally attached to the end thereof for securably engaging a ladder support surface;

a top plate having a front edge opposite a rear edge wherein said front vertical step assembly is pivotally attached to said front edge and said rear vertical support assembly is pivotally attached to said rear edge;

a first folding stabilizer cross member in combination with a second folding stabilizer cross member, said first folding stabilizer cross member traversing between said first support leg and said first support rail and pivotally attached thereto, and said second folding stabilizer cross member traversing between said second support leg and said second housing support member and pivotally attached thereto, said first and second folding stabilizer cross members capable of locking said vertical step assembly and said vertical support assembly in an extended position;

lateral stability indicating means secured to said top plate; and longitudinal stability indicating means secured to said top plate;

wherein the length of said support legs and said housing support members can be adjusted in order to accommodate placing said adjustable leveling ladder on uneven surfaces, said lateral stability indicating means and said longitudinal stability indicating means providing indication of when said adjustable leveling ladder has achieved a position of safe operation.

2. The adjustable leveling stepladder of claim 1 wherein said rung rail locking mechanism further comprises an adjustment aperture in said support leg at an end opposite said top plate and a series of adjustment apertures spaced along the length of said telescoping support member, wherein a threaded locking pin is passed through linearly adjustment locking apertures in said support leg and said telescoping support member and secured by a locking nut.

3. The adjustable leveling stepladder of claim 2 wherein said support rail locking mechanism further comprises a support aperture in said housing support member at the end opposite said top plate and a series of adjustment apertures spaced along the length of said telescoping support member, wherein a threaded locking pin is passed through linearly aligned adjustment apertures in said housing support member and said telescoping support member and secured by a locking nut.

4. The adjustable leveling stepladder of claim 3 wherein the spacing of said locking apertures along said telescoping support members is between 0.5 and 1.5 inches providing a high degree of adjustability in said supporting legs and said housing support members.

5. The adjustable leveling stepladder of claim 1 wherein said lateral stability indicating means and said longitudinal stability indicating means further comprise a bubble level measuring device.

* * * * *